US008457953B2

(12) United States Patent
Bruhn

(10) Patent No.: US 8,457,953 B2
(45) Date of Patent: Jun. 4, 2013

(54) METHOD AND ARRANGEMENT FOR SMOOTHING OF STATIONARY BACKGROUND NOISE

(75) Inventor: Stefan Bruhn, Sollentuna (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 939 days.

(21) Appl. No.: 12/530,333

(22) PCT Filed: Feb. 13, 2008

(86) PCT No.: PCT/SE2008/050169

§ 371 (c)(1),
(2), (4) Date: Sep. 8, 2009

(87) PCT Pub. No.: WO2008/108719

PCT Pub. Date: Sep. 12, 2008

(65) Prior Publication Data

US 2010/0114567 A1 May 6, 2010

Related U.S. Application Data

(60) Provisional application No. 60/892,994, filed on Mar. 5, 2007.

(51) Int. Cl.
*G10L 19/00* (2006.01)

(52) U.S. Cl.
USPC ..... 704/219; 704/264; 704/262; 704/233; 704/226; 704/225; 704/220; 704/208; 704/207; 704/205; 704/200.1; 379/406.01; 375/232

(58) Field of Classification Search
USPC ..... 379/406.01; 704/219, 263, 262, 704/233, 226, 225, 220, 208, 207, 205, 200.1; 375/232
See application file for complete search history.

(56) References Cited

U.S. PATENT DOCUMENTS

| | | | | | |
|---|---|---|---|---|---|
| 4,667,340 | A | * | 5/1987 | Arjmand et al. | 704/207 |
| 5,233,660 | A | * | 8/1993 | Chen | 704/208 |
| 5,696,874 | A | * | 12/1997 | Taguchi | 704/219 |
| 5,727,125 | A | * | 3/1998 | Bergstrom et al. | 704/264 |
| 5,749,065 | A | * | 5/1998 | Nishiguchi et al. | 704/200.1 |
| 5,781,880 | A | * | 7/1998 | Su | 704/207 |

(Continued)

FOREIGN PATENT DOCUMENTS

| | | |
|---|---|---|
| EP | 1100076 A2 | 5/2001 |
| EP | 1204092 A2 | 5/2002 |

OTHER PUBLICATIONS

Murashima et al, A Post-Processing Technique to Improve Coding Quality of CELP Under Background Noise, NEC Corporation, 2000, pp. 102-104.*

(Continued)

*Primary Examiner* — Michael Colucci

(57) ABSTRACT

In a method of smoothing background noise in a telecommunication speech session; receiving and decoding S1O a signal representative of a speech session, the signal comprising both a speech component and a background noise component. Subsequently, determining LPC parameters S20 and an excitation signal S30 for the received signal. Thereafter, synthesizing and outputting (S40) an output signal based on the determined LPC parameters and excitation signal. In addition, modifying S35 the determined excitation signal by reducing power and spectral fluctuations of the excitation signal to provide a smoothed output signal.

12 Claims, 5 Drawing Sheets

U.S. PATENT DOCUMENTS

| | | | | |
|---|---|---|---|---|
| 5,890,108 | A * | 3/1999 | Yeldener | 704/208 |
| 5,909,663 | A * | 6/1999 | Iijima et al. | 704/226 |
| 5,960,389 | A * | 9/1999 | Jarvinen et al. | 704/220 |
| 6,064,962 | A * | 5/2000 | Oshikiri et al. | 704/262 |
| 6,163,608 | A * | 12/2000 | Romesburg et al. | 379/406.01 |
| 6,269,331 | B1 * | 7/2001 | Alanara et al. | 704/205 |
| 6,272,459 | B1 | 8/2001 | Takahashi | |
| 6,526,376 | B1 * | 2/2003 | Villette et al. | 704/207 |
| 6,910,009 | B1 * | 6/2005 | Murashima | 704/225 |
| 7,010,480 | B2 * | 3/2006 | Gao et al. | 704/219 |
| 7,305,337 | B2 * | 12/2007 | Wang et al. | 704/207 |
| 7,478,042 | B2 * | 1/2009 | Ehara et al. | 704/233 |
| 2001/0033616 | A1 * | 10/2001 | Rijnberg et al. | 375/232 |

OTHER PUBLICATIONS

Murashima, A et al: "A post-processing technique to improve coding quality of CELP under background noise", Speech Coding, 2000. Proceedings. 2000 IEEE Workshop on, pp. 102-104, 2000, the whole document, especially the abstract, chapters 1, 3.1 and 3.2.

* cited by examiner

METHOD AND ARRANGEMENT FOR SMOOTHING OF STATIONARY BACKGROUND NOISE

This application claims the benefit of U.S. Provisional Application No. 60/892,994, filed Mar. 5, 2007, the disclosure of which is fully incorporated herein by reference.

TECHNICAL FIELD

The present invention relates to speech coding in telecommunication systems in general, especially to methods and arrangements for smoothing of stationary background noise in such systems.

BACKGROUND

Speech coding is the process of obtaining a compact representation of voice signals for efficient transmission over band-limited wired and wireless channels and/or storage. Today, speech coders have become essential components in telecommunications and in the multimedia infrastructure. Commercial systems that rely on efficient speech coding include cellular communication, voice over internet protocol (VOIP), videoconferencing, electronic toys, archiving, and digital simultaneous voice and data (DSVD), as well as numerous PC-based games and multimedia applications.

Being a continuous-time signal, speech may be represented digitally through a process of sampling and quantization. Speech samples are typically quantized using either 16-bit or 8-bit quantization. Like many other signals a speech signal contains a great deal of information that is either redundant (nonzero mutual information between successive samples in the signal) or perceptually irrelevant (information that is not perceived by human listeners). Most telecommunication coders are lossy, meaning that the synthesized speech is perceptually similar to the original but may be physically dissimilar.

A speech coder converts a digitized speech signal into a coded representation, which is usually transmitted in frames. Correspondingly, a speech decoder receives coded frames and synthesizes reconstructed speech.

Many modern speech coders belong to a large class of speech coders known as LPC (Linear Predictive Coders). A few examples of such coders are: the 3GPP FR, EFR, AMR and AMR-WB speech codecs, the 3GPP2 EVRC, SMV and EVRC-WB speech codecs, and various ITU-T codecs such as G.728, G723, G.729, etc.

These coders all utilize a synthesis filter concept in the signal generation process. The filter is used to model the short-time spectrum of the signal that is to be reproduced, whereas the input to the filter is assumed to handle all other signal variations.

A common feature of these synthesis filter models is that the signal to be reproduced is represented by parameters defining the synthesis filter. The term "linear predictive" refers to a class of methods often used for estimating the filter parameters. In LPC based coders, the speech signal is viewed as the output of a linear time-invariant (LTI) system whose input is the excitation signal to the filter. Thus, the signal to be reproduced is partially represented by a set of filter parameters and partly by the excitation signal driving the filter. The advantage of such a coding concept arises from the fact that both the filter and its driving excitation signal can be described efficiently with relatively few bits.

One particular class of LPC based codecs are based on the so-called analysis-by-synthesis (AbS) principle. These codecs incorporate a local copy of the decoder in the encoder and find the driving excitation signal of the synthesis filter by selecting that excitation signal among a set of candidate excitation signals which maximizes the similarity of the synthesized output signal with the original speech signal.

The concept of utilizing such a liner predictive coding and particularly AbS coding has proven to work relatively well for speech signals, even at low bit rates of e.g. 4-12 kbps. However, when the user of a mobile telephone using such coding technique is silent and the input signal comprises the surrounding sounds e.g. noise, the presently known coders have difficulties coping with this situation, since they are optimized for speech signals. A listener on the receiving side may easily get annoyed when familiar background sounds cannot be recognized since they have been "mistreated" by the coder.

So-called swirling causes one of the most severe quality degradations in the reproduced background sounds. This is a phenomenon occurring in relatively stationary background noise sounds such as car noise and is caused by non-natural temporal fluctuations of the power and the spectrum of the decoded signal. These fluctuations in turn are caused by inadequate estimation and quantization of the synthesis filter coefficients and its excitation signal. Usually, swirling becomes less when the codec bit rate increases.

Swirling has been identified as a problem in prior art and multiple solutions to it have been proposed in the literature. One of the proposed solutions is described in U.S. Pat. No. 5,632,004 [1]. According to this patent, during speech inactivity the filter parameters are modified by means of low pass filtering or bandwidth expansion such that spectral variations of the synthesized background sound are reduced. This method was refined in U.S. Pat. No. 5,579,432 [2] such that the described anti-swirling technique is only applied upon detected stationary of the background noise.

One further method addressing the swirling problem is described in U.S. Pat. No. 5,487,087 [3]. This method makes use of a modified signal quantization scheme which matches both the signal itself and its temporal variations. In particular, it is envisioned to use such a reduced-fluctuation quantizer for LPC filter parameters and signal gain parameters during periods of inactive speech.

Signal quality degradations caused by undesired power fluctuations of the synthesized signal are addressed by another set of methods. One of them is described in U.S. Pat. No. 6,275,798 [4] and is also a part of the AMR speech codec algorithm described in 3GPP TS 26.090 [5]. According to it, the gain of at least one component of the synthesized filter excitation signal, the fixed codebook contribution, is adaptively smoothed depending on the stationarity of the LPC short-term spectrum. This method has been evolved in patent EP 1096476 [6] and patent application EP 1688920 [7] where the smoothing further involves a limitation of the gain to be used in the signal synthesis. A related method to be used in LPC vocoders is described in U.S. Pat. No. 5,953,697 [8]. According to it, the gain of the excitation signal of the synthesis filter is controlled such that the maximum amplitude of the synthesized speech just reaches the input speech waveform envelope.

Yet a further class of methods addressing the swirling problem operates as a post processor after the speech decoder. Patent EP 0665530 [9] describes a method which during detected speech inactivity replaces a portion of the speech decoder output signal by a low-pass filtered white noise or comfort noise signal. Similar approaches are taken in various publications that disclose related methods replacing part of the speech decoder output signal with filtered noise.

Scalable or embedded coding, with reference to FIG. 1, is a coding paradigm in which the coding is performed in layers. A base or core layer encodes the signal at a low bit rate, while additional layers, each on top of the other, provide some enhancement relative to the coding, which is achieved with all layers from the core up to the respective previous layer. Each layer adds some additional bit rate. The generated bit stream is embedded, meaning that the bit stream of lower-layer encoding is embedded into bit streams of higher layers. This property makes it possible anywhere in the transmission or in the receiver to drop the bits belonging to higher layers. Such stripped bit stream can still be decoded up to the layer which bits are retained.

The most common scalable speech compression algorithm today is the 64 kbps G.711 A/U-law logarithm PCM codec. The 8 kHz sampled G.711 codec coverts 12 bit or 13 bit linear PCM samples to 8 bit logarithmic samples. The ordered bit representation of the logarithmic samples allows for stealing the Least Significant Bits (LSBs) in a G.711 bit stream, making the G.711 coder practically SNR-scalable between 48, 56 and 64 kbps. This scalability property of the G.711 codec is used in the Circuit Switched Communication Networks for in-band control signaling purposes. A recent example of use of this G.711 scaling property is the 3GPP TFO protocol that enables Wideband Speech setup and transport over legacy 64 kbps PCM links. Eight kbps of the original 64 kbps G.711 stream is used initially to allow for a call setup of the wideband speech service without affecting the narrowband service quality considerably. After call setup, the wideband speech will use 16 kbps of the 64 kbps G.711 stream. Other older speech coding standards supporting open-loop scalability are G.727 (embedded ADPCM) and to some extent G.722 (sub-band ADPCM).

A more recent advance in scalable speech coding technology is the MPEG-4 standard that provides scalability extensions for MPEG4-CELP. The MPE base layer may be enhanced by transmission of additional filter parameter information or additional innovation parameter information. The International Telecommunications Union-Standardization Sector, ITU-T has recently ended the standardization of a new scalable codec G.729.1, nicknamed s G.729.EV. The bit rate range of this scalable speech codec is from 8 kbps to 32 kbps. The major use case for this codec is to allow efficient sharing of a limited bandwidth resource in home or office gateways, e.g. shared xDSL 64/128 kbps uplink between several VOIP calls.

One recent trend in scalable speech coding is to provide higher layers with support for the coding of non-speech audio signals such as music. In such codecs the lower layers employ mere conventional speech coding, e.g. according to the analysis-by-synthesis paradigm of which CELP is a prominent example. As such coding is very suitable for speech only but not that much for non-speech audio signals such as music, the upper layers work according to a coding paradigm, which is used in audio codecs. Here, typically the upper layer encoding works on the coding error of the lower-layer coding.

Another relevant method concerning speech codecs is so-called spectral tilt compensation, which is done in the context of adaptive post filtering of decoded speech. The problem solved by this is to compensate for the spectral tilt introduced by short-term or formant post filters. Such techniques are a part of e.g. the AMR codec and the SMV codec and primarily target the performance of the codec during speech rather than its background noise performance. The SMV codec applies this tilt compensation in the weighted residual domain before synthesis filtering though not in response to an LPC analysis of the residual.

The problem with the above described methods of U.S. Pat. No. 5,632,004, U.S. Pat. No. 5,579,432, and U.S. Pat. No. 5,487,087 is that they assume that the LPC synthesis filter excitation has a white (i.e. flat) spectrum and that all spectral fluctuations causing the swirling problem are related to the fluctuations of the LPC synthesis filter spectra. This is however not the case and especially not if the excitation signal is only coarsely quantized. In that case, spectral fluctuations of the excitation signal have a similar effect as LPC filter fluctuations and need hence to be avoided.

The problem with the methods addressing undesired power fluctuations of the synthesized signal is that they are only addressing one part of swirling problem, but do not provide a solution related to spectral fluctuations. Simulations show that even in combination with the cited methods addressing the spectral fluctuations still not all swirling related signal quality degradations during stationary background sounds can be avoided.

One problem with the methods operating as a post processor after the speech decoder is that they replace only a portion of the speech decoded output signal with a smoothed noise signal. Hence, the swirling problem is not solved in the remaining signal portion originating from the speech decoder and hence the final output signal is not shaped using the same LPC synthesis filter as the speech decoder output signal. This may lead to possible sound discontinuities especially during transitions from inactivity to active speech. In addition, such post processing methods are disadvantageous, as they require relatively high computational complexity.

None of the existing methods provides a solution to the problem that one of the reasons for swirling lies in spectral fluctuations of the excitation signal of the LPC synthesis filter. This problem becomes severe especially if the excitation signal is represented with too few bits, which is typically the case for speech codecs operating at bit rates of 12 kbps or lower.

Consequently, there is a need for methods and arrangements for alleviating the above-described problems with swirling caused by stationary background noise during periods of voice inactivity.

SUMMARY

An object of the present invention is to provide improved quality of speech signals in a telecommunication system.

A further object is to provide enhanced quality of a speech decoder output signal during periods of speech inactivity with stationary background noise.

The present invention discloses methods and arrangements of smoothing background noise in a telecommunication speech session. Basically, the method according to the invention comprise the steps of receiving and decoding S10 a signal representative of a speech session, said signal comprising both a speech component and a background noise component. Subsequently, determining LPC parameters S20 and an excitation signal S30 for the received signal. Thereafter, synthesizing and outputting (S40) an output signal based on the determined LPC parameters and excitation signal. In addition, prior to the synthesis step, modifying S35 the determined excitation signal by reducing power and spectral fluctuations of the excitation signal to provide a smoothed output signal.

Advantages of the present invention comprise:

Enabling an improved speech decoder output signal;

Enabling a smooth speech decoder output signal.

BRIEF DESCRIPTION OF THE DRAWINGS

The invention, together with further objects and advantages thereof, may best be understood by making reference to the following description taken together with the accompanying drawings, in which.

ABBREVIATIONS

AbS Analysis by Synthesis
ADPCM Adaptive Differential PCM
AMR-WB Adaptive Multi Rate Wide Band
EVRC-WB Enhanced Variable Rate Wideband Codec
CELP Code Excited Linear Prediction
ISP Immittance Spectral Pair
ITU-T International Telecommunication Union
LPC Linear Predictive Coders
LSF Line Spectral Frequency
MPEG Moving Pictures Experts Group
PCM Pulse Code Modulation
SMV Selectable Mode Vocoder
VAD Voice Activity Detector

DETAILED DESCRIPTION

The present invention will be described in the context of a speech session e.g. telephone call, in a general telecommunication system. Typically, the methods and arrangements will be implemented in a decoder suitable for speech synthesis. However, it is equally possible that the methods and arrangements are implemented in an intermediary node in the network and subsequently transmitted to a targeted user. The telecommunication system may be both wireless and wireline.

Consequently, the present invention enables methods and arrangements for alleviating the above-described known problems with swirling caused by stationary background noise during periods of voice inactivity in a telephone speech session. Specifically, the present invention enables enhancing the quality of a speech decoder output signal during periods of speech inactivity with stationary background noise.

Within this disclosure, the term speech session is to be interpreted as any exchange of vocal signals over a telecommunication system. Accordingly, a speech session signal can be described as comprising an active part and a background part. The active part is the actual voice signal of the session. The background part is the surrounding noise at the user, also referred to as background noise. An inactivity period is defined as a time period within a speech session where there is no active part, only a background part, e.g. the voice part of the session is inactive.

According to a basic embodiment, the present invention enables improving the quality of a speech session by reducing the power variations and spectral fluctuations of the LPC synthesis filter excitation signal during detecting periods of speech inactivity.

According to a further embodiment, the output signal is further improved by combining the excitation signal modification with an LPC parameter smoothing operation.

Figure 1:
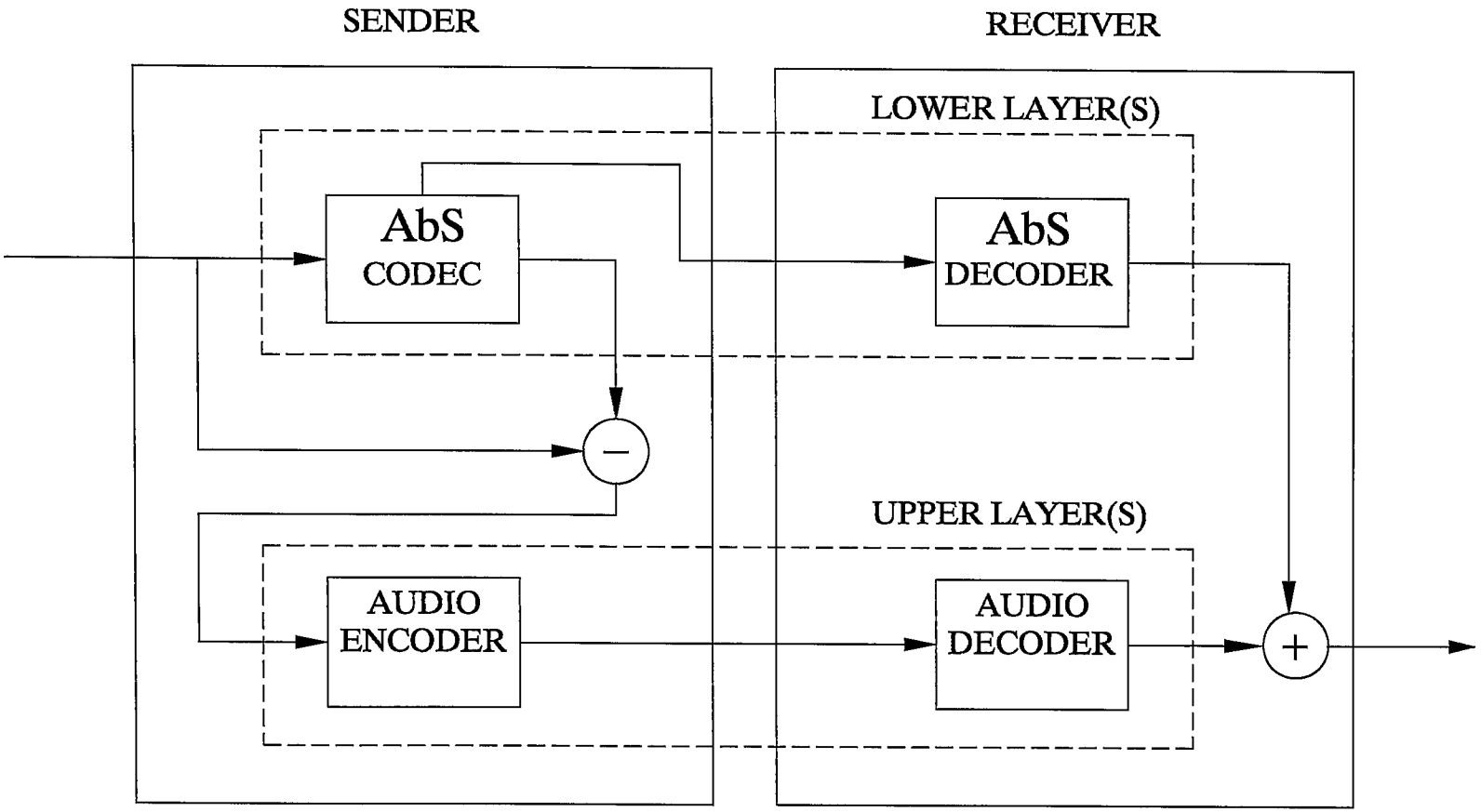
FIG. 1 is a block schematic of a scalable speech and audio codec.
Figure 2:
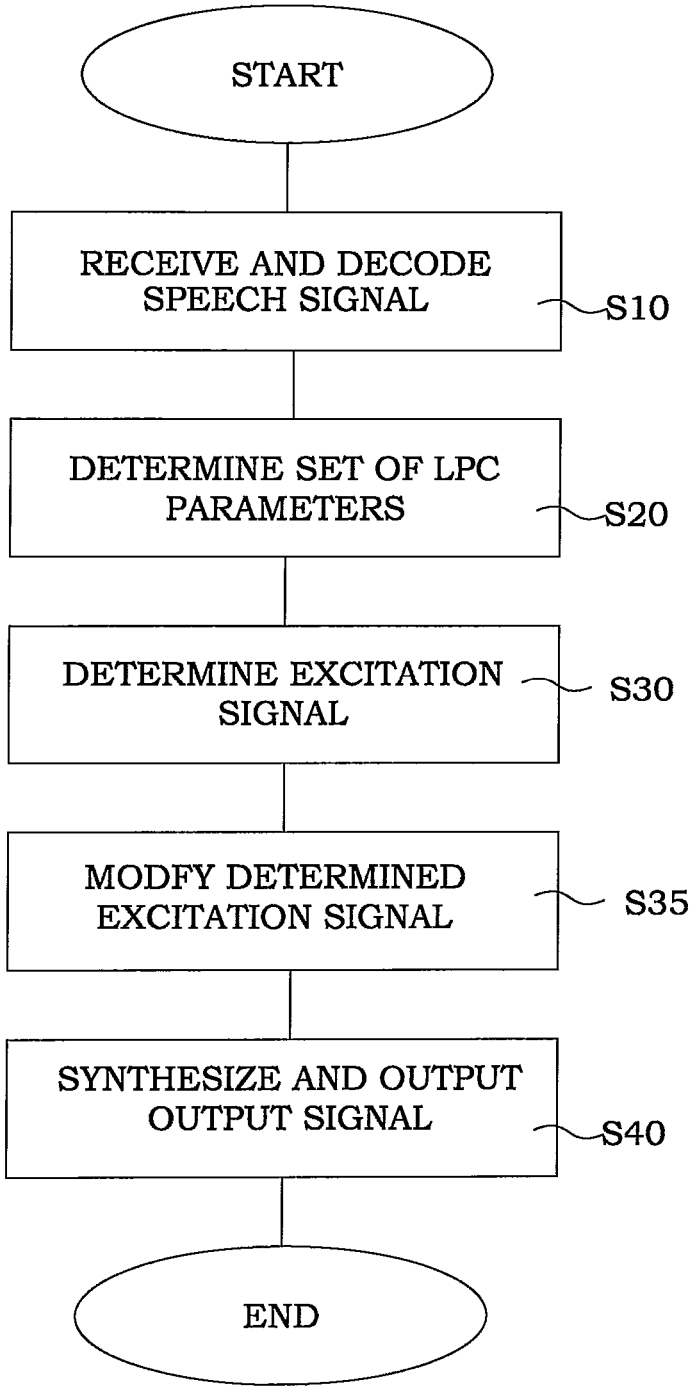
FIG. 2 is a flow diagram illustrating an embodiment of a method according to the present invention.

With reference to the flow chart of FIG. 2, an embodiment of a method according to the present invention comprises receiving and decoding S10 a signal representative of a speech session (i.e. comprising a speech component in the form of an active voice signal and/or a stationary background noise component). Subsequently, a set of LPC parameters are determined S20 for the received signal. In addition, an excitation signal is determined S30 for the received signal. An output signal is synthesized and output S40 based on the determined LPC parameters and the determined excitation signal. According to the present invention, the excitation signal is improved or modified S35 by reducing the power and spectral fluctuations of the excitation signal to provide a smoothed output signal.

Figure 3:
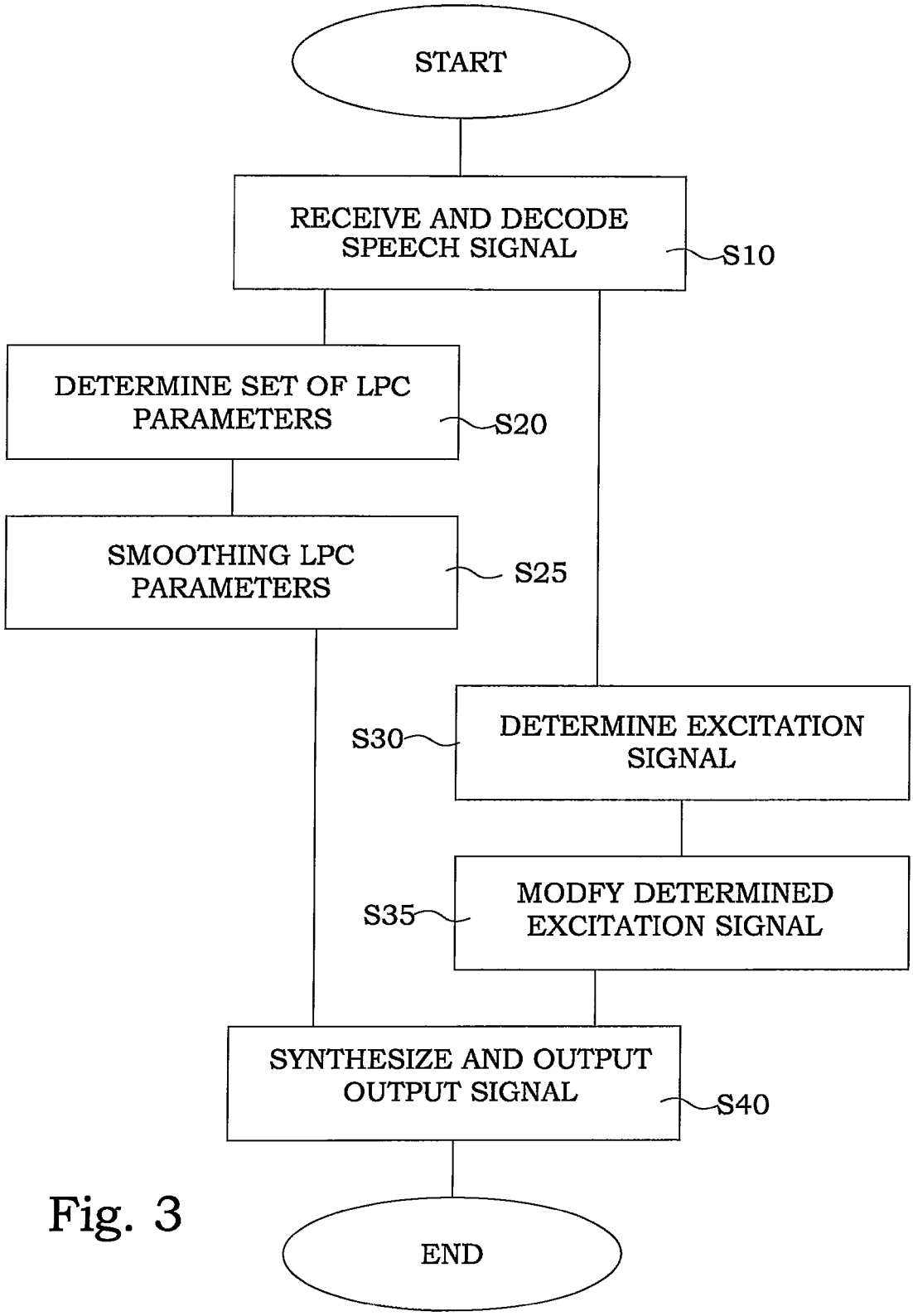
FIG. 3 is a flow diagram of a further embodiment of a method according to the present invention.

With reference to the flow chart of FIG. 3, a further embodiment of a method according to the present invention will be described. Corresponding steps retain the same reference numerals as the ones in FIG. 2. In addition to the step of modifying the excitation signal of the previously described embodiment, also the determined set of LPC parameters is subjected to a modifying operation S25, e.g. LPC parameter smoothing.

Figure 4:
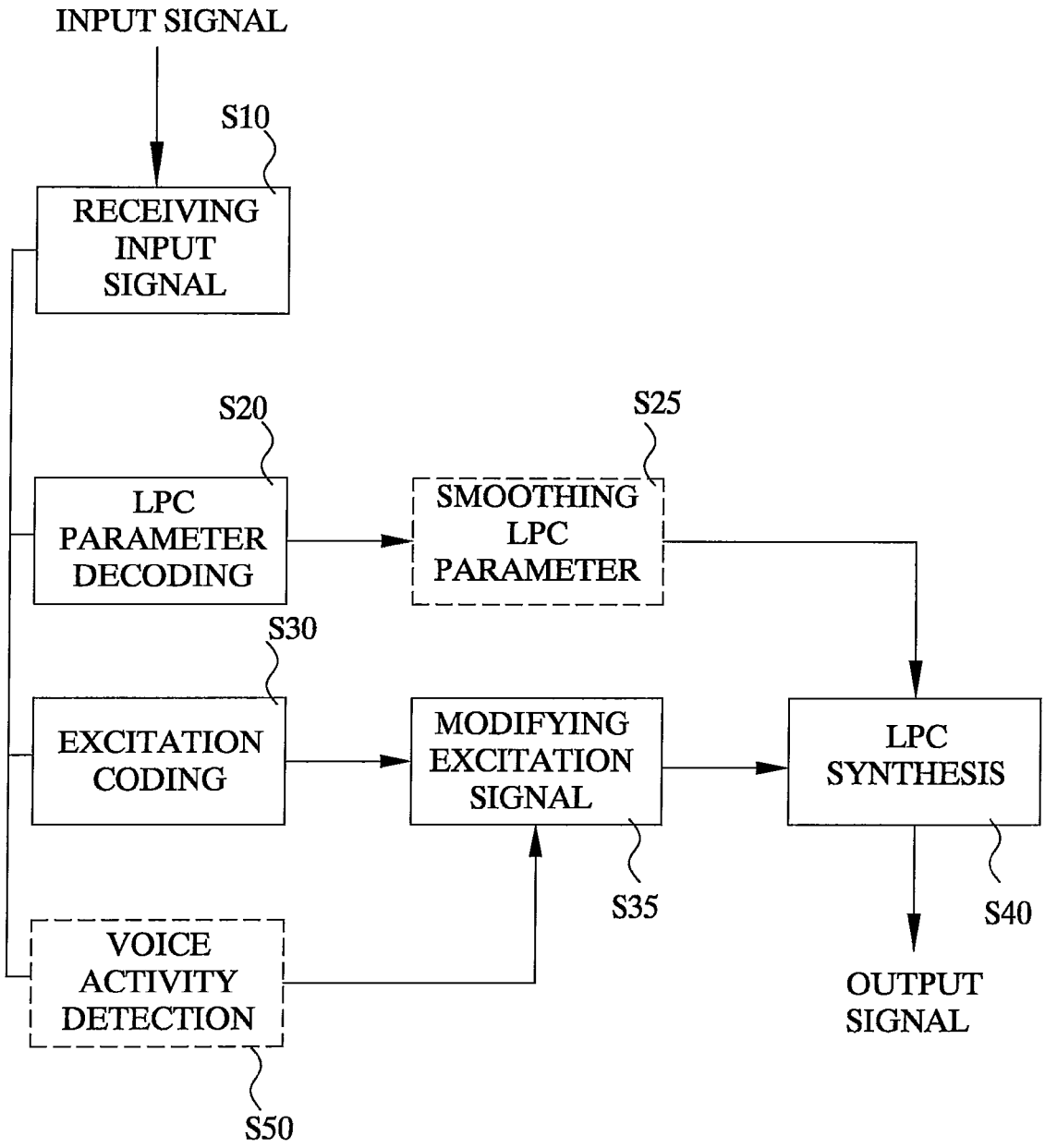
FIG. 4 is a block diagram illustrating embodiments of a method according to the present invention.

The LPC parameter smoothing S25 according to a further embodiment of the present invention, with reference to FIG. 4, comprises performing the LPC parameter smoothing in such a manner that the degree of smoothing is controlled by some factor $\beta$, which in turn is derived from a parameter referred to as noisiness factor.

In a first step, a low pass filtered set of LPC parameters is calculated S20. Preferably, this is done by first-order autoregressive filtering according to:

$$\tilde{\alpha}(n)=\lambda\cdot\tilde{\alpha}(n-1)+(1-\lambda)\cdot\alpha(n) \quad (1)$$

Here $\tilde{\alpha}(n)$ represents the low pass filtered LPC parameter vector obtained for a present frame n, $\alpha(n)$ is the decoded LPC parameter vector for frame n, and $\lambda$ is a weighting factor controlling the degree of smoothing. A suitable choice for $\lambda$ is 0.9.

In a second step S25, a weighted combination of the low pass filtered LPC parameter vector $\tilde{\alpha}(n)$ and the decoded LPC parameter vector $\alpha(n)$ is calculated using the smoothing control factor $\beta$, according to:

$$\hat{\alpha}(n)=(1-\beta)\cdot\tilde{\alpha}(n)+\beta\cdot\alpha(n) \quad (2)$$

The LPC parameters may be in any representation suitable for filtering and interpolation and preferably be represented as line spectral frequencies (LSFs) or immittance spectral pairs (ISPs).

Typically, the speech decoder may interpolate the LPC parameters across sub-frames in which preferably also the low-pass filtered LPC parameters are interpolated accordingly. In one particular embodiment the speech decoder operates with frames of 20 ms length and 4 subframes of 5 ms each within a frame. If the speech decoder originally calculates the 4 subframe LPC parameter vectors by interpolating between an end-frame LPC parameter vector $\alpha(n-1)$ of the previous frame, a mid frame LPC parameter vector $\alpha_m(n)$ and an end-frame LPC parameter vector $\alpha(n)$ of the present frame, then the weighted combination of the low pass filtered LPC parameter vectors and the decoded LPC parameter vectors is calculated as follows:

$$\hat{\alpha}(n-1)=(1-\beta)\cdot\tilde{\alpha}(n-1)+\beta\cdot\alpha(n-1) \quad (3)$$

$$\hat{\alpha}_m(n-1)=(1-\beta)\cdot 0.5\cdot(\tilde{\alpha}(n-1)+\tilde{\alpha}(n))+\beta\cdot\alpha_m(n-1) \quad (4)$$

$$\hat{\alpha}(n)=(1-\beta)\cdot\tilde{\alpha}(n)+\beta\cdot\alpha(n) \quad (5)$$

Subsequently, these smoothed LPC parameter vectors are used for subframe-wise interpolation, instead of the original decoded LPC parameter vectors $\alpha(n-1)$, $\alpha_m(n)$, and $\alpha(n)$.

As previously, an important element of the present invention is the reduction of power and spectrum fluctuations of the LPC filter excitation signal during periods of voice inactivity. According to a preferred embodiment of the invention, the modification is done such that the excitation signal has fewer fluctuations in the spectral tilt and that essentially an existing spectral tilt is compensated.

Consequently, it is taken into account and recognized by the inventors that many speech codecs (and AbS codecs in particular) do not necessarily produce tilt-free or white excitation signals. Rather, they optimize the excitation with the target to match the original input signal with the synthesized signal, which especially in case of low-rate speech coders may lead to significant fluctuations of the spectral tilt of the excitation signal from frame to frame.

Tilt compensation can be done with a tilt compensation filter (or whitening filter) H(z) according to:

$$H_{(z)} = 1 - \sum_{k=1}^{P} a_i \cdot z^{-i} \quad (6)$$

The coefficients of this filter $\alpha_i$ are readily calculated as LPC coefficients of the original excitation signal. A suitable choice of the predictor order P is 1 in which case essentially merely tilt compensation rather than whitening is carried out. In that case, the coefficient $\alpha_1$ is calculated as $$a_1 = \frac{r_e(1)}{r_e(0)} \quad (7)$$

where $r_e(0)$ and $r_e(1)$ are the zeroth and first autocorrelation coefficients of the original LPC synthesis filter excitation signal.

The described tilt compensation or whitening operation is preferably done at least once for each frame or once for each subframe.

According to an alternative particular embodiment, the power and spectral fluctuations of the excitation signal can also be reduced by replacing a part of the excitation signal with a white noise signal. To this end, first a properly scaled random sequence is generated. The scaling is done such that its power equals the power of the excitation signal or the smoothed power of the excitation signal. The latter case is preferred and the smoothing can be done by low pass filtering of estimates of the excitation signal power or an excitation gain factor derived from it. Accordingly, an unsmoothed gain factor g(n) is calculated as square root of the power of the excitation signal. Then the low pass filtering is performed, preferably by first-order autoregressive filtering according to:

$$\tilde{g}(n)=\kappa\cdot\tilde{g}(n-1)+(1-\kappa)\cdot g(n) \quad (8)$$

Here $\tilde{g}(n)$ represents the low pass filtered gain factor obtained for the present frame n and $\kappa$ is a weighting factor controlling the degree of smoothing. A suitable choice for $\kappa$ is 0.9. If the original random sequence has normalized power (variance) of 1, then after scaling to the noise signal r, its power corresponds to the power of the excitation signal or of the smoothed power of the excitation signal. It is noted that the smoothing operation of the gain factor could also be done in the logarithmic domain according to $$\log(\tilde{g}(n))=\kappa\cdot\log(\tilde{g}(n-1))+(1-\kappa)\cdot\log(g(n)) \quad (9)$$

In a next step, the excitation signal is combined with the noise signal. To this end the excitation signal e is scaled by some factor $\alpha$, the noise signal r is scaled with some factor $\beta$ and then the two scaled signals are added:

$$\hat{e}'=\alpha\cdot e+\beta\cdot r \quad (10)$$

The factor $\beta$ may but need not necessarily correspond to the control factor $\beta$ used for LPC parameter smoothing. It may again be derived from a parameter referred to as noisiness factor. According to a preferred embodiment, the factor $\beta$ is chosen as $1-\alpha$. In that case a suitable choice for $\alpha$ is 0.5 or larger, though less or equal to 1. However, unless $\alpha$ equals 1 it is observed that the signal $\hat{e}'$ has smaller power than excitation signal e. This effect in turn may cause undesirable discontinuities in the synthesized output signal in the transitions between inactivity and active speech. In order to solve this problem it has to be considered that e and r generally are statistically independent random sequences. Consequently, the power of the modified excitation signal depends on the factor $\alpha$ and the powers of the excitation signal e and the noise signal r, as follows:

$$P\{\hat{e}'\}=\alpha^2\cdot P\{e\}+(1-\alpha)^2\cdot P\{r\} \quad (11)$$

Hence, in order to ensure that the modified excitation signal has a proper power it has to be scaled further by a factor $\gamma$.

$$\hat{e}=\gamma\cdot\hat{e}' \quad (12)$$

Under the simplified assumption (ignoring the power smoothing of the noise signal described above) that the power of the noise signal and the desired power of the modified excitation signal are identical to the power of the excitation signal P{e}, it is found that factor $\gamma$ has to be chosen as follows:

$$\gamma = \frac{1}{\sqrt{\alpha^2 + (1-\alpha)^2}} \quad (13)$$

A suitable approximation is to scale only the excitation signal with a factor $\gamma$ but not the noise signal:

$$\hat{e}=\gamma\cdot\alpha\cdot e+(1-\alpha)\cdot r \quad (14)$$

The described noise mixing operation is preferably done once for each frame, but could also be done once for each sub-frame.

In the course of careful investigations, it has been found that preferably the described tilt compensation (whitening) and the described noise modification of the excitation signal are done in combination. In that case, best quality of the synthesized background noise signal can be achieved when the noise modification operates with the tilt compensated excitation signal rather than the original excitation signal of the speech decoder.

In order to make the method work even more optimally it may be necessary to ensure that neither LPC parameter smoothing nor the excitation modifications affect the active speech signal. According to a basic embodiment and with reference to FIG. 4, this is possible if the smoothing operation is activated in response to a VAD indicating speech inactivity S50.

A further preferred embodiment of the invention is its application in a scalable speech codec. A further improved overall performance can be achieved by the steps of adapting the described smoothing operation of stationary background noise to the bit rate at which the signal is decoded. Preferably the smoothing is only done in the decoding of the low rate lower layers while it is turned off (or reduced) when decoding at higher bit rates. The reason is that higher layers usually do not suffer that much from swirling and a smoothing operation could even affect the fidelity at which the decoder re-synthesizes the speech signal at higher bit rate.

Figure 5:
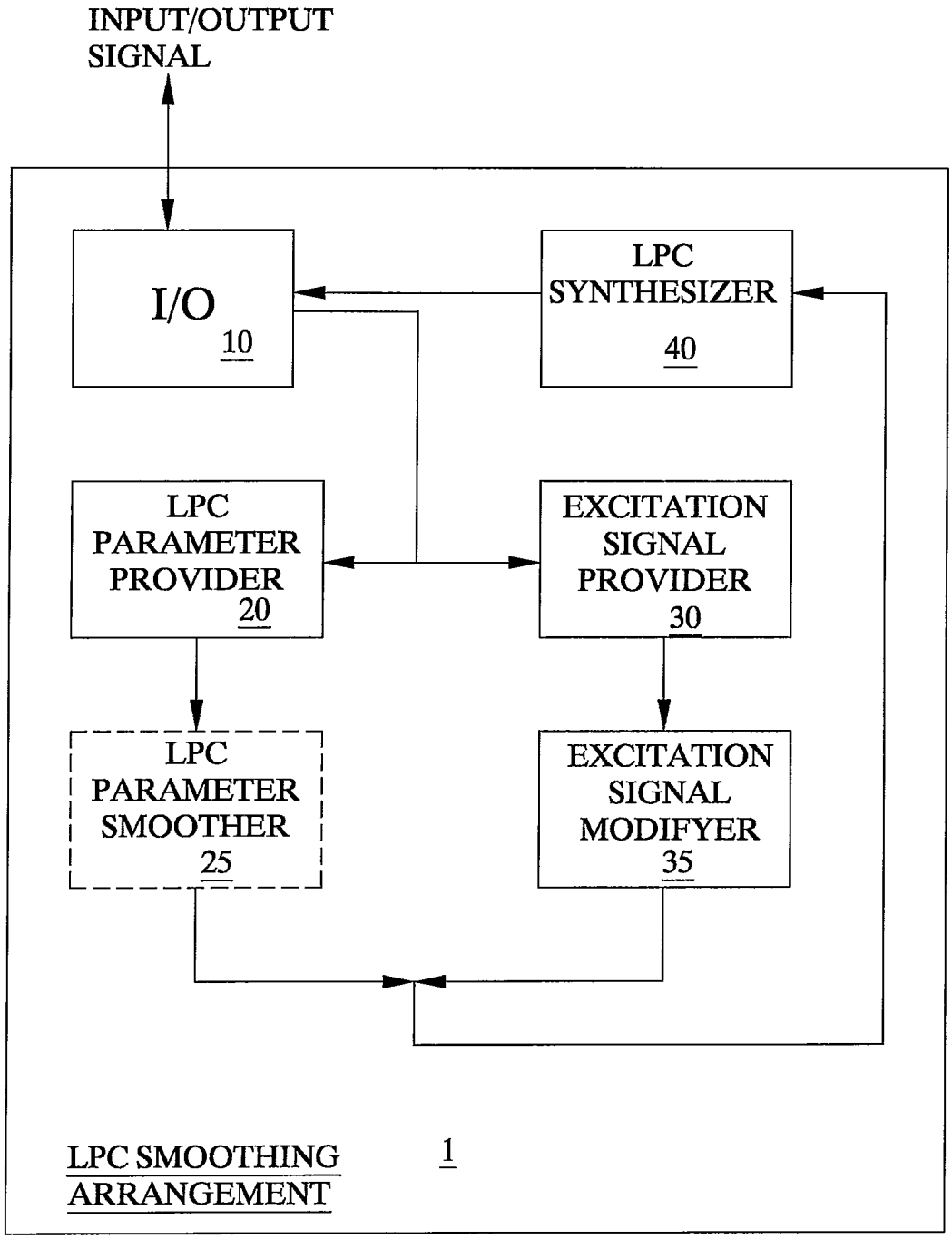
FIG. 5 is an illustration of an embodiment of an arrangement according to the present invention.

With reference to FIG. 5, an arrangement 1 in a decoder enabling the method according to the present invention will be described.

The arrangement 1 comprises a general output/input unit I/O 10 for receiving input signals and transmitting output signals from the arrangement. The unit preferably comprises any necessary functionality for receiving and decoding signals to the arrangement. Further, the arrangement 1 comprises an LPC parameter unit 20 for decoding and determining LPC parameters for the received and decoded signal, and an excitation unit 30 for decoding and determining an excitation signal for the received input signal. In addition, the arrangement 1 comprises a modifying unit 35 for modifying the determined excitation signal by reducing the power and spectral fluctuations of the excitation signal. Finally, the arrangement 1 comprises an LPC synthesis unit or filter 40 for providing a smoothed synthesized speech output signal based at least on the determined LPC parameters and the modified determined excitation signal.

According to a further embodiment, also with reference to FIG. 5, the arrangement comprises a smoothing unit 25 for smoothing the determined LPC parameters from the LPC parameter unit 20. In addition, the LPC synthesis unit 40 is adapted to determine the synthesized speech signal based on at least on the smoothed LPC parameters and the modified excitation signal.

Finally, the arrangement can be provided with a detection unit for detecting if the speech session comprises an active voice part e.g. someone is actually talking, or if there is only a background noise present, e.g. one of the users is quiet and the mobile is only registering the background noise. In that case, the arrangement is adapted to only perform the modifying steps if there is an inactive voice part of the speech session. In other words, the smoothing operation of the present invention (LPC parameter smoothing and/or excitation signal modifying) is only performed during periods of voice inactivity.

Advantages of the present invention comprise:

With the present invention, it is possible to improve the reconstruction or synthesized speech signal quality of stationary background noise signals (like car noise) during periods of speech inactivity.

It will be understood by those skilled in the art that various modifications and changes may be made to the present invention without departure from the scope thereof, which is defined by the appended claims.

REFERENCES

[1] U.S. Pat. No. 5,632,004.
[2] U.S. Pat. No. 5,579,432.
[3] U.S. Pat. No. 5,487,087.
[4] U.S. Pat. No. 6,275,798 B1.
[5] 3GPP TS 26.090, AMR Speech Codec; Transcoding functions.
[6] EP 1096476.
[7] EP 1688920
[8] U.S. Pat. No. 5,953,697
[9] EP 665530 B1

The invention claimed is:

1. A method of smoothing background noise in a telecommunication speech session, comprising receiving and decoding a signal representative of a speech session, said signal comprising both a speech component and a background noise component;

determining LPC parameters for said received signal;

determining an excitation signal for said received signal;

synthesizing and outputting an output signal based on said LPC parameters and said excitation signal, characterized by:

modifying said determined set of LPC parameters by providing a low pass filtered set of LPC parameters, and determining a weighted combination of said low pass filtered set and said determined set of LPC parameters, and performing said synthesis and outputting step based on said modified set of LPC parameters to provide a smoothed output signal;

modifying said determined excitation signal by reducing power and spectral fluctuations of the excitation signal and thus provide a smoothed output signal.

2. The method according to claim 1, comprising performing said low pass filtering by first order autoregressive filtering.

3. The method according to claim 1, comprising said step of modifying said excitation signal comprising modifying a spectrum of said excitation signal by compensating a tilt.

4. The method according to claim 1, comprising said step of modifying the excitation signal further comprising replacing at least part of the excitation signal with a white noise signal.

5. The method according to claim 4, comprising the steps of scaling a power of said white noise signal to be equal to the power of the determined excitation signal or a smoothed representative thereof, and linearly combining the determined excitation signal and the scaled noise signal to provide said modified excitation signal.

6. The method according to claim 5, comprising performing said linear combination such that the power of the modified excitation signal is equal to the power of the original excitation signal.

7. The method according to claim 1, further comprising the step of determining if said speech component is active or inactive.

8. The method according to claim 7, comprising performing said modifying step only if said speech component is inactive.

9. A smoothing apparatus, comprising means for receiving and decoding a signal representative of a speech session, said signal comprising both a speech component and a background noise component;

means for determining LPC parameters for said received signal;

means for determining an excitation signal for said received signal;

means for synthesizing an output signal based on said LPC parameters and said excitation signal, comprising:

means for modifying said determined set of LPC parameters by providing a low pass filtered set of LPC parameters, said means being adapted to determine a weighted combination of said low pass filtered set and said determined set of LPC parameters, and said synthesis means are adapted to synthesize said output signal based on said modified set of LPC parameters to provide a smoothed output signal, and means for modifying said determined excitation signal by reducing power and spectral fluctuations of the excitation signal and thus provide a smoothed output signal.

10. The apparatus according to claim 9, comprising further means for detecting an inactive state of said speech component.

11. The apparatus according to claim 10, wherein said excitation signal modifying means is adapted to perform said modifying step in response to a detected inactive speech component.

12. The apparatus of claim 9, wherein the smoothing apparatus is comprised in a decoder unit in a telecommunication system.

* * * * *